US007678318B2

(12) United States Patent
Line et al.

(10) Patent No.: US 7,678,318 B2
(45) Date of Patent: Mar. 16, 2010

(54) TOUCH FASTENER PRODUCTS

(75) Inventors: Kevin Keith Line, Ontario (CA); Daniel Lee Janzen, Ontario (CA); Paul Joseph Voigt, Ontario (CA)

(73) Assignee: Velcro Industries B.V., Curacao (AN)

( * ) Notice: Subject to any disclaimer, the term of this patent is extended or adjusted under 35 U.S.C. 154(b) by 0 days.

(21) Appl. No.: 12/124,361

(22) Filed: May 21, 2008

(65) Prior Publication Data

US 2008/0284060 A1 Nov. 20, 2008

Related U.S. Application Data

(62) Division of application No. 10/791,204, filed on Mar. 2, 2004, now Pat. No. 7,425,360.

(51) Int. Cl.
*B29C 39/02* (2006.01)

(52) U.S. Cl. ..... 264/274; 264/275; 264/279

(58) Field of Classification Search ..... 264/274, 264/275, 279, 299, 328.1
See application file for complete search history.

(56) References Cited

U.S. PATENT DOCUMENTS

| | | | |
|---|---|---|---|
| 4,470,857 | A | 9/1984 | Casalou |
| 4,563,380 | A | 1/1986 | Black et al. |
| 4,617,214 | A | 10/1986 | Billarant |
| 4,673,542 | A | 6/1987 | Wigner et al. |
| 4,693,921 | A | 9/1987 | Billarant et al. |
| 4,710,414 | A | 12/1987 | Northrup et al. |
| 4,726,975 | A | 2/1988 | Hatch |
| 4,775,310 | A | 10/1988 | Fischer |
| 4,784,890 | A | 11/1988 | Black |
| 4,794,028 | A | 12/1988 | Fischer |
| 4,802,939 | A | 2/1989 | Billarant et al. |
| 4,814,036 | A | 3/1989 | Hatch |
| 4,842,916 | A | 6/1989 | Ogawa et al. |
| 4,870,725 | A | 10/1989 | Dubowik |
| 4,881,997 | A | 11/1989 | Hatch |
| 4,931,344 | A | 6/1990 | Ogawa et al. |
| 4,933,035 | A | 6/1990 | Billarant et al. |
| 5,061,540 | A | 10/1991 | Cripps et al. |
| 5,110,649 | A | 5/1992 | Morse et al. |
| 5,180,618 | A | 1/1993 | Kessler et al. |
| 5,259,905 | A | 11/1993 | Gilcreast |
| 5,286,431 | A | 2/1994 | Banfield et al. |

(Continued)

FOREIGN PATENT DOCUMENTS

| | | |
|---|---|---|
| DE | 3903847 | 8/1990 |

(Continued)

OTHER PUBLICATIONS

International Search Report, PCT/IB2005/002140, dated Oct. 10, 2005.

*Primary Examiner*—Kat Wyrozebski
*Assistant Examiner*—Daniel Lee
(74) *Attorney, Agent, or Firm*—Fish & Richardson P.C.

(57) ABSTRACT

Touch fasteners for use as mold inserts in molding seat foam buns include selvedges that deflect under pressure to engage a mold surface in face-to-face contact. Another touch fastener includes a base with an exposed thermally activatable resin surface that has a softening point low enough to be activated by the exothermic foaming reaction to adhere the fastener in the foam bun.

36 Claims, 7 Drawing Sheets

U.S. PATENT DOCUMENTS

| | | | |
|---|---|---|---|
| 5,422,156 | A | 6/1995 | Billarant |
| 5,500,268 | A | 3/1996 | Billarant |
| 5,518,795 | A | 5/1996 | Kennedy et al. |
| 5,540,970 | A | 7/1996 | Banfield et al. |
| 5,606,781 | A | 3/1997 | Provost et al. |
| 5,614,045 | A | 3/1997 | Billarant |
| 5,654,070 | A | 8/1997 | Billarant |
| 5,665,449 | A | 9/1997 | Billarant |
| 5,688,576 | A | 11/1997 | Ohno et al. |
| 5,725,928 | A | 3/1998 | Kenney et al. |
| 5,736,217 | A | 4/1998 | Banfield et al. |
| 5,766,385 | A | 6/1998 | Pollard et al. |
| 5,766,723 | A | 6/1998 | Oborny et al. |
| 5,786,061 | A | 7/1998 | Banfield |
| 5,795,640 | A | 8/1998 | Billarant |
| 5,840,398 | A | 11/1998 | Billarant |
| 5,900,303 | A | 5/1999 | Billarant |
| 5,922,436 | A | 7/1999 | Banfield et al. |
| 5,932,311 | A | 8/1999 | Kenney et al. |
| 5,942,177 | A | 8/1999 | Banfield |
| 5,945,193 | A | 8/1999 | Pollard et al. |
| 5,972,465 | A | 10/1999 | Ohno et al. |
| 6,129,970 | A | 10/2000 | Kenney et al. |
| 6,148,487 | A | 11/2000 | Billarant |
| 6,299,954 | B1 | 10/2001 | Schulte |
| 6,348,252 | B1 | 2/2002 | Kenney et al. |
| 6,460,230 | B2 | 10/2002 | Shimamura et al. |
| 6,463,635 | B2 | 10/2002 | Murasaki |
| 6,468,624 | B1 | 10/2002 | Fujisawa et al. |
| 6,537,643 | B1 | 3/2003 | Poulakis |
| 6,540,863 | B2 | 4/2003 | Kenney et al. |
| 6,596,371 | B1 | 7/2003 | Billarant et al. |
| 6,656,563 | B1 | 12/2003 | Leach et al. |
| 6,668,429 | B2 | 12/2003 | Fujisawa et al. |
| 6,720,059 | B2 | 4/2004 | Fujisawa et al. |
| 2002/0023322 | A1 | 2/2002 | Murasaki |
| 2002/0031637 | A1 | 3/2002 | Obony et al. |
| 2002/0058123 | A1 | 5/2002 | Kenney et al. |
| 2002/0164449 | A1 | 11/2002 | Fujisawa et al. |
| 2003/0034723 | A1* | 2/2003 | Mehan et al. ..... 313/318.01 |
| 2003/0099811 | A1 | 5/2003 | Poulakis |
| 2003/0134083 | A1 | 7/2003 | Wang et al. |
| 2003/0214068 | A1 | 11/2003 | Fujisawa et al. |
| 2004/0103503 | A1 | 6/2004 | Leach et al. |
| 2004/0108620 | A1 | 6/2004 | Leach et al. |
| 2004/0128804 | A1 | 7/2004 | Billarant |

FOREIGN PATENT DOCUMENTS

| | | |
|---|---|---|
| DE | 19956011 | 6/2001 |
| EP | 0 145 603 | 6/1985 |
| EP | 0439969 A1 | 8/1991 |
| EP | 0 621 118 | 10/1994 |
| WO | WO96/25064 | 8/1996 |

* cited by examiner

TOUCH FASTENER PRODUCTS

CROSS-REFERENCE TO RELATED APPLICATIONS

This application is a divisional application of and claims priority to U.S. application Ser. No. 10/791,204, filed on Mar. 2, 2004 now U.S. Pat. No. 7,425,360, and incorporated herein by reference in its entirety.

TECHNICAL FIELD

This invention relates to touch fastener products, and particularly to the use of touch fastener products as mold inserts, such as in the molding of seat foam buns and the like.

BACKGROUND

Seats for cars and light trucks have been formed by molding a foam bun that will serve as the seat cushion, and then attaching a pre-stitched fabric cover to the foam bun. Often, the fabric cover is attached to the foam bun by insert molding touch fastener products into the outer surface of the foam bun and attaching cooperating touch fastener products to an inner surface of the fabric cover. Generally, the fastener products are attached to the fabric cover along the seams where the cover is stitched together and held in place by the seam stitching. The touch fastener products allow the seat manufacturer to rapidly and semi-permanently attach the fabric cover to the foam bun by pulling the fabric cover over the foam bun and pressing the opposed touch fastener products on the foam bun and fabric cover together.

In general, the touch fastener products can be secured to the seat foam bun during a molding process, such as by holding the fastener products magnetically against a side of the mold cavity in which the foam bun is molded. During this molding process, care must be taken to avoid fouling of the fastener elements with the liquid foamable composition used to form the seat. Fouling can occur if the liquid foaming composition leaks between the edges of the base of the touch fastener product and the mold surface into the space between the fastener elements (e.g., hooks).

SUMMARY

In one aspect, the invention features a touch fastener product for use as a mold insert. The product includes a base having upper faces and lower faces and a central portion disposed between lateral selvedges, the central portion having a nominal thickness, a magnetically attractable material secured to an upper face of the base; and a plurality of fastener elements extending in an array from the lower face of the central portion of the base, wherein the selvedges are of a significantly lesser stiffness than the stiffness of the central portion of the base, for flexure of the selvedges to conform to a mold surface as the base of the fastener product is drawn against the mold surface by magnetic attraction of the magnetically attractable material.

In some embodiments, the touch fastener is formed of a single contiguous resin.

In some embodiments, the central portion includes a strip of a first material supporting the fastener elements, and the selvedges are formed of a second material of different composition than the first material. For example, the strip of first material can have a surface integrally formed with stems of the fastener elements, or the selvedges can include regions of a film secured to the upper face of the base. The film can be secured by an adhesive such as a polyamide hot melt. The film can have one or more of the following properties: the film can be a polyamide film, the film can have a softening point of between about 120 and 220 degrees Fahrenheit, the film can have a nominal thickness of less than about 0.020 inch, for example about 0.010 inches or less, or about 0.005 inches or less, and the film can have a flexural rigidity of between about 1500 and 2000 mg-cm, e.g., about 1800 mg-cm.

In some embodiments, the nominal thickness of the central portion of the base is between about 0.002 and 0.012 inch.

In some embodiments, the nominal thickness of the central portion of the base is greater than a nominal thickness of the selvedges.

In some embodiments, the magnetically attractable material includes a metal wire, a metal strip, or a coating of magnetically attractable particles.

In some embodiments, the magnetically attractable material is encapsulated in a hot melt adhesive.

In some embodiments, each selvedge extends from the array at least about 2 millimeters, for example each selvedge extends from the array at least about 4 millimeters.

In some embodiments, the selvedges are of a material having a flexural rigidity of between about 1000 and 3000 mg-cm, e.g., about 1500 and 2000 mg-cm, preferably about 1800 mg-cm.

In some embodiments, selvedges are disposed on all sides of the central portion of the base.

In some embodiments, the central portion of the base includes a molded resin.

In some embodiments, the fastener elements are male fastener elements. In some cases, the male fastener elements include stems integrally molded with the central portion of the base, the central portion of the base including a molded resin. In some cases, the male fastener elements have loop-engagable heads molded at distal ends of the stems. In some cases, the male fastener elements are hook-shaped.

In some embodiments, the fastener elements are arranged in a density of at least about 100 per square inch across the array.

In some embodiments, the fastener elements have an overall height, as measured normal to the base, of less than about 0.050 inch.

In another aspect, the invention features a method of forming a seat foam bun. The method includes providing a mold cavity having a shape corresponding to the shape of the seat foam bun, wherein the mold cavity includes a tapered trench having angled side walls, providing a touch fastener including a base, a plurality of fastener elements extending from a lower face of a central portion of the base in an array disposed between lateral selvedges of the base, positioning the touch fastener along the trench with the selvedges deflected from their unloaded position to extend along the trench side walls in face-to-face contact, and delivering a foamable resin into the mold cavity to form a seat foam bun, the deflected selvedges resisting intrusion of foamable resin into the array of fastener elements.

In some embodiments, a lower face of the selvedges has a substantially flat surface.

In some embodiments, the selvedges are of a significantly lesser stiffness than a stiffness of the central portion of the base.

In some embodiments, the trench has Hat side walls extending at acute angles from a bottom surface of the trench.

In some embodiments, the trench has curved side walls, the selvedges-conforming to arcuate surfaces of the trench side walls.

In some embodiments, in an unloaded condition, the selvedges and central portion of the base lie in a common plane, the distal edges of the selvedges deflected out of the common plane with the fastener positioned along the trench.

In some embodiments, the distal edges of the selvedges contact the trench side walls with the fastener positioned along the trench.

In some embodiments, the selvedges are disposed around all sides of the central portion of the base.

In some embodiments, the selvedges comprise a film, for example a polyamide. In some cases, the film is adhered to the base, for example with a polyamide hot melt resin. In some cases, the film has a softening point between 120 and 220 degrees Fahrenheit.

In some embodiments, the central portion of the base has a nominal thickness of between about 0.002 and 0.012 inch.

In some embodiments, the central portion of the base is thicker than the selvedges.

In some embodiments, the touch fastener includes a magnetically attractable material. In some cases, the magnetically attractable material is disposed on the upper face of the central portion of the base. In some cases, the selvedges are substantially free of magnetically attractable material. In some instances, the trench overlays a magnet.

In some embodiments, the trench is elongated, and the fastener product is in strip form. In some embodiments, the trench is a circular plateau and the fastener product is in circular form.

In some embodiments, the fastener elements are male fastener elements having stems integrally molded with a surface of the central portion of the base.

In some embodiments, the foamable resin comprises a polyurethane resin.

In another aspect, the invention features a seat foam bun. The seat foam bun includes a plateau disposed on a surface thereof, and positioned on the plateau is a touch fastener including a base and a plurality of fastener elements extending from a central portion of the base in an array disposed between selvedges of the base, wherein the selvedges are embedded in the foam and extend about opposite upper side edges of the plateau.

In some embodiments, the selvedges are lateral selvedges.

In some embodiments, the plateau is an elongated plateau. In some embodiments, the plateau is a circular plateau.

In some embodiments, the selvedges have a stiffness that is substantially less than a stiffness of the central portion of the base.

In some embodiments, the central portion of the base includes a resin.

In some embodiments, the selvedges include a film.

In some embodiments, the film has a softening point between 120 and 220 degrees Fahrenheit.

In some embodiments, the film is adhered to the central portion of the base.

In some embodiments, the central portion of the base is thicker than the selvedges.

In some embodiments, the selvedges extend laterally beyond the central portion at least about 2 mm.

In some embodiments, the touch fastener includes a magnetically attractable material.

In some embodiments, a magnetically attractable material is disposed on the central portion of the base.

In some embodiments, an exposed surface of the selvedges is substantially smooth.

In some embodiments, the foam is a polyurethane foam.

In another aspect, the invention features a touch fastener. The touch fastener includes a sheet-form base including an upper face and a lower face, a plurality of fastener elements disposed in an array on the lower face of the sheet-form base, a magnetically attractable material secured to the upper face of the sheet-form base; and a film disposed on the upper face of the base, wherein the Film has a softening point lower than about 220 degrees Fahrenheit.

In some embodiments, the softening point of the film is lower than about 180 degrees Fahrenheit, for example lower than about 150 degrees Fahrenheit.

In some embodiments, the film is between about 0.002 and 0.010 inch thick.

In some embodiments, the film includes a polyamide.

In some embodiments, the film is disposed over substantially the entire upper face of the base.

In some embodiments, the touch fastener also includes a material secured to the lower face of the base, wherein the material surrounds at least a portion of the array of fastener elements.

In some embodiments, the magnetically attractable material is a metal wire, or a coating of metal particles.

In some embodiments, the magnetically attractable material is disposed in a strip extending substantially an entire length of the touch fastener and substantially centered in a width of the touch fastener.

In some embodiments, the touch fastener also includes selvedges extending laterally beyond the array of fastener elements, wherein the selvedges include a substantially flat surface configured to engage a flat surface of a mold in face-to-face contact.

In some embodiments, the selvedges are integrally molded with the base.

In some embodiments, the selvedges include a film disposed on the upper surface of the base.

In another aspect, the invention features a method of forming a seat foam bun. The method includes providing a mold cavity having a shape corresponding to a desired shape of the foam bun, positioning a touch fastener in the mold cavity, the touch fastener including a sheet-form base having an upper face and a lower face, a plurality of fastener elements disposed on the lower face of the sheet-form base, and a thermally-activatable resin exposed on the upper face of the sheet-form baseband delivering a foamable resin into the mold cavity causing the resin to foam in an exothermic reaction, wherein the reaction generates sufficient heat to activate at least an outer surface of the activatable resin to adhere the touch fastener to the foam.

In some embodiments, the foamable resin includes a polyurethane.

In some embodiments, the activatable resin is activated at a temperature between about 120 and 220 degrees Fahrenheit.

In some embodiments, the activatable resin comprises a film, for example a polyamide film.

In some embodiments, the resin is disposed over substantially the entire upper face of the base.

In some embodiments, the touch fastener includes a magnetically attractable materially disposed on the upper face of the base.

In some embodiments, the magnetically attractable material is a metal wire laterally centered over the fastener elements.

In some embodiments, the touch fastener includes a material disposed on the lower face of the base, the material surrounding the plurality of fastener elements and forming a gasket between the base and a surface of the mold cavity.

In some embodiments, the touch fastener includes selvedges extending laterally beyond the plurality of fastener elements.

In some embodiments, the selvedges extend longitudinally beyond the plurality of fastener elements.

In some embodiments, the selvedges are integrally molded with the base.

In some embodiments, the selvedges include a film disposed on the upper surface of the base.

In some embodiments, the selvedges include a smooth surface that engages a mold surface in face-to-face contact.

In another aspect, the invention features a touch fastener for use as a mold insert in which a molded surface can be formed. The touch fastener includes a sheet-form base including an upper face and a lower face, a plurality of fastener elements extending from the lower face of the sheet-form base disposed in an array, and a magnetically attractable material secured to the sheet-form base, wherein a portion of the sheet-form base extends laterally beyond the array of male fastener elements and forms selvedges on opposite edges of the sheet-form base, the selvedges being free of the magnetically attractable material, and having smooth, planar lower faces for engaging a flat mold surface in face-to-face contact on either side of the array to form a seal on either side of the array.

In some embodiments, the fastener elements are male fastener elements having stems integrally molded to the lower face of the sheet-form base.

In some embodiments, the magnetically attractable material includes a metal wire.

In some embodiments, each selvedge extends from the array at least about 2 mm.

In some embodiments, the width of the array of fastener elements is between about 2 mm and 10 mm.

In some embodiments, the length of the touch fastener is at least about 200 mm.

In some embodiments, the touch fastener also includes a material disposed on the upper face of the sheet-form base.

In some embodiments, the touch fastener also includes a film disposed on the upper surface of the sheet-form base, wherein the softening point of the film is between about 140 and about 220 degrees Fahrenheit.

In another aspect, the method features a method of forming a seat form bun, including the following steps: providing a mold cavity having a shape corresponding to a desired shape of the foam bun and defining a trench overlying a magnet, providing a touch fastener mold insert, the insert including a sheet-form base including an upper face and a lower face, a plurality of fastener elements extending; from the lower face of the sheet-form base disposed in an array; and a magnetically attractable material secured to the sheet-form base, a portion of the sheet-form base extending laterally beyond the array of male fastener elements and forming selvedges on opposite edges of the sheet-form base, the selvedges having smooth, planar lower faces, positioning the insert in the trench to establish a magnetic attraction between the attractable material and the magnet, thereby creating area contact pressure between the smooth, lower faces of the selvedges and mold surfaces on either side of the trench to form a seal; and delivering a foamable resin into the mold cavity to form a seat bun.

In some embodiments, the fastener elements are male fastener elements having stems integrally molded to the lower face of the sheet-form base.

In some embodiments, the foam is a polyurethane foam.

In some embodiments, the magnetically attractable material is encapsulated in a polyamide hot melt composition.

In some embodiments, the magnetically attractable material includes a metal wire.

In some embodiments, the magnetically attractable material extends over substantially the entire length of the touch fastener and is substantially centered over a width of the touch fastener.

In some embodiments, the magnetically attractable material includes a coating of metal particles.

In some embodiments, the coating of metal particles is substantially centered over a width of the touch fastener.

In some embodiments, each selvedge extends from the array at least about 2 mm, for example, each selvedge can extend from the array at least about 4 mm.

In some embodiments, the width of the array of fastener elements is between about 2 mm and 10 mm.

In some embodiments, the length of the touch fastener is at least about 200 mm.

In some embodiments, sheet-form base is between about 0.002 inches and 0.012 inches thick.

In some embodiments, the method also includes a touch fastener having a material disposed on the upper face of the sheet-form base.

In some embodiments, the material is a woven material.

In some embodiments, the method also includes a touch fastener having a film disposed on the upper surface of the sheet-form base, wherein the softening point of the film is between about 140 and about 220 degrees Fahrenheit.

In some embodiments, the male fastener elements include molded hooks or mushroom shapes.

The term "stiffness" as used herein refers to the resistance of a sheet-form material to bend out of its plane when subjected to a normal bending force, and is synonymous with flexural rigidity.

At least some of the touch fasteners described herein can be used in molding processes without requiring a gasket to protect the fastener elements from being fouled with foam used to form a to the touch fastener (for example to form a gasket), thus reducing manufacturing costs. This can eliminate an additional manufacturing step of securing a separate material In some aspects, the touch fastener products, when used in a molding process, can reduce the hindrance of the flow of foamable resin during the forming of a seat foam bun. For example, by having selvedges that lie flat in face-to-face contact with a mold surface, the selvedges create only a minor ridge. Accordingly, the foamable resin can pass over the touch fastener without creating a significant disturbance in the flow of the resin (for example, as can occur when the advancing foamable resin meets an impediment), which can result in undesirable variations in foam density.

By molding a touch fastener into a plateau portion of a seat form bun, with selvedges of the fastener extending over the edges of the plateau, the touch fastener can have improved adhesion to the seat form bun and be more resistant to tear. The improved adhesion can result from conversion of at least some normal fastener separation load into a shear force between the angled selvedges and the foam.

In instances where the selvedges are formed of a material more flexible than the central portion of the touch fastener, the stress at the edges of the touch fasteners may be reduced. For example, in some instances the selvedges can bend more easily to maintain contact with the surface of the seat foam bun in instances where the seat foam bun is subjected to a compressing stress.

By providing a touch fastener with a back surface of a resin having a softening point near or lower than the reaction temperature during bun molding, the touch fastener can have improved adhesion to the seat form bun through heat activation of the exposed resin from the exothermic foaming reaction.

The details of one or more embodiments of the invention are set forth in the accompanying drawings and the description below. Other features, objects, and advantages of the invention will be apparent from the description and drawings, and from the claims.

DESCRIPTION OF DRAWINGS

The figures depicted herein are intended to aid the reader's understanding of various features of the invention disclosed herein. Accordingly, the drawings are for illustration only and are not necessarily drawn to scale. Like reference symbols in the various drawings indicate like elements.

DETAILED DESCRIPTION

Figure 1:
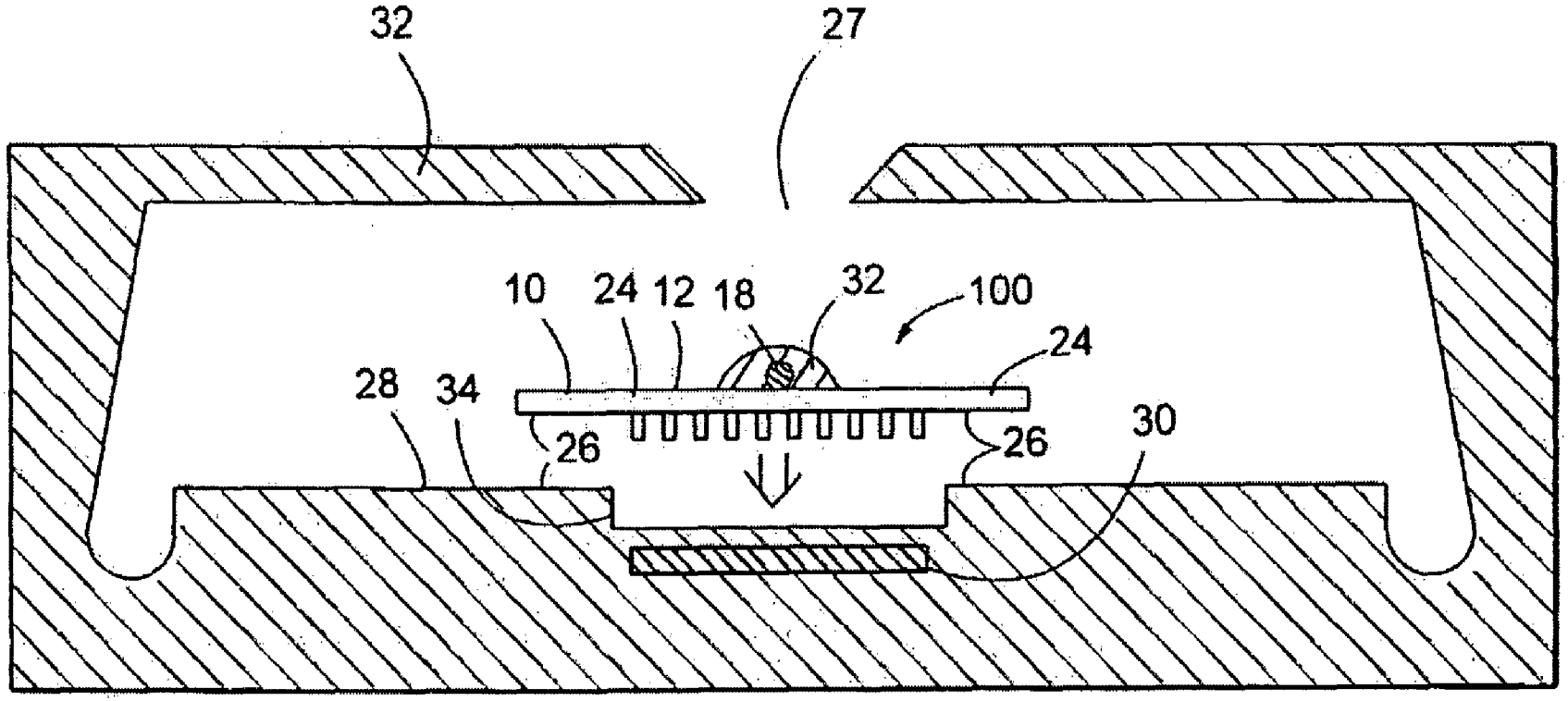
FIG. 1 is a cross-sectional view of a touch fastener being positioned in a mold cavity.

In one aspect, the invention features a touch fastener 100 for use as a mold insert. Referring to FIG. 1, touch fastener 100 includes a sheet-form base 10 having an upper face 12 and a lower face 14. Fastener elements 16 extend from the lower face 14 of sheet-form base 10 in an array 20. A metal wire 18 is adhered with an adhesive 22 to the upper face 12 of sheet-form base 10. Selvedges 24 extend laterally from the sheet-form base 10 beyond either side of the array 20. Lower faces 26 of selvedges 24 are smooth, planar surfaces, which can engage a flat mold surface 28 in face-to-face contact.

In some instances, as depicted in FIG. 1, a magnet 30 can be positioned in a mold 32 to position touch fastener 100 in a trench portion 34 of the flat mold surface 28. With the fastener so positioned, a foamable liquid resin is poured into the mold cavity 27. An exothermic reaction occurs, causing the liquid resin to foam up to fill the cavity. The foam adheres or is otherwise secured to the fastener, which becomes a part of the surface of the foam bun removed from the cavity.

Figure 2:
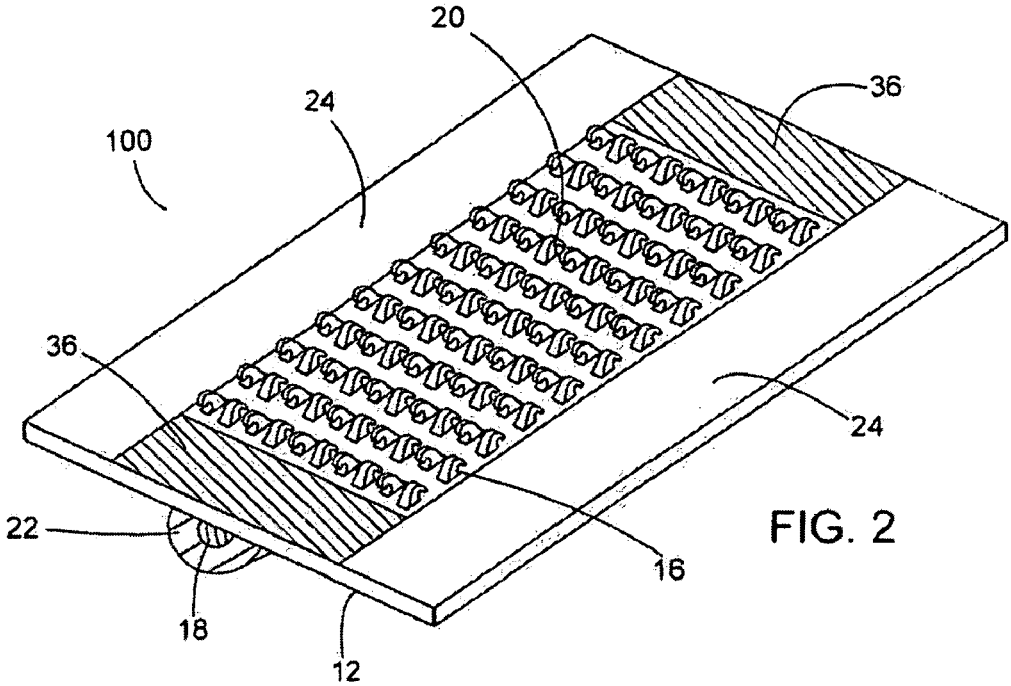
FIG. 2 is a perspective view of a touch fastener having selvedges.

FIG. 2 is a perspective view of touch fastener 100. Smooth, planar selvedges 24 extend laterally beyond array 20 of male fastener elements 16. Methods of forming molded touch fasteners having stems or fastener elements extending integrally therefrom are well known in the art. For example, a continuous extrusion/roll-forming method for molding fastener elements on an integral, sheet-form base is described in detail in U.S. Pat. Nos. 4,794,028 and in 4,775,310, the entire disclosures of which are incorporated herein by reference.

In some instances, the touch fastener product can be laminated to a mesh or scrim material. The scrim material can provide improved dimensional stability. Moreover, the scrim material can be magnetic (e.g., a ferrous-impregnated non-woven material), thus providing a magnetically attractable material as discussed above. Suitable examples of laminates are described in U.S. Pat. No. 5,518,795 to Kennedy et al. entitled LAMINATED HOOK FASTENER, the entire disclosure of which is incorporated herein by reference.

After a continuous length of touch fastener 100 is formed, it is cut to a defined length and then male fastener elements 16 are removed from opposite longitudinal ends of array 20 to provide flat portions 36 of the lower face 14 of sheet-form base 10. Alternatively, the fastener elements may be formed to be of such small size that they need not be removed from the longitudinal ends to effect sealing against foam intrusion across the fastener element array. A metal wire 18 is centered laterally over the array 20 of male fastener elements 16, and adhered to the upper face 12 of sheet-form base 10 with an adhesive 22, either before or after the base is cut to length.

In general, the array of touch fasteners is an array of hooks having a length of about 200 mm and a width of about 4 mm. The selvedges each generally have widths of about 4 mm. The flat portions of the lower face of the sheet form base extend longitudinally beyond the fastener array about 4 mm. The sheet form base is constructed from a resin, such as a polyester, polypropylene, nylon, or other, and has a nominal thickness of about between about 0.002 and 0.020 inch, for example 0.005 inch.

Figure 3:
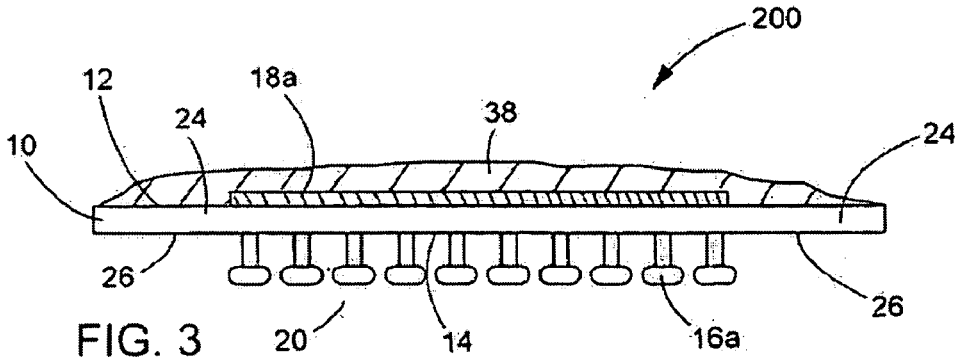
FIG. 3 is a cross-sectional view of a touch fastener having a material adhered thereto.

An alternate embodiment of a touch fastener for use as a mold insert is depicted in FIG. 3. Touch fastener 200 includes a sheet-form base 10 having an upper face 12 and a lower face 14. A strip of magnetically attractable material 18*a*, such as iron, for example an iron wire, iron particles, steel, etc., is secured to the upper face 14 of the sheet-form base 12. Positioned over the magnetically attractable material 18*a* and secured on the upper face 12 of the sheet-form base 10, for example with an adhesive, is material 38, such as a woven or a non-woven material, or a knit of fiber, for example a cardboard or paper material. Alternatively, material 38 may be laminated directly to the molten resin of base 10 as the fastener element stems are molded, thereby encapsulating material 18*a*, using a combination of techniques taught by Kennedy et al (cited above) and Kenney et al. (U.S. Pat. No. 5,945,193), the entire contents of which are hereby incorporated by reference. In some instances, material 38 provides improved adhesion of touch fastener 200 to a seat foam bun. Male fastener elements 16*a* are molded integrally with and extend from the lower face 14 of the sheet-form base 10 in an array 20. Selvedges 24 having smooth, planar lower faces 26 extend laterally beyond the array 20 of male fastener elements 16 and can engage in face-to-face contact with a flat mold surface.

Figure 4:
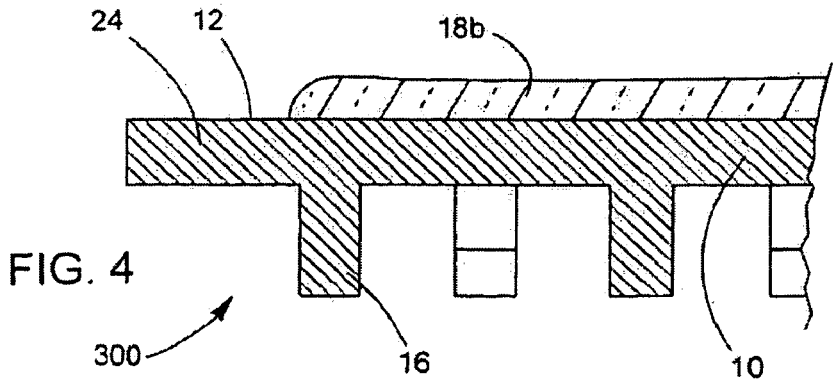
FIG. 4 is a cross-sectional view of a touch fastener having a coating of magnetically attractable material secured thereto.

In some instances, as depicted in FIG. 4, a touch fastener 300 can have adhered to an upper face 12 of a sheet-form base 10 a coating of magnetically attractable material 18*b*. In the configuration shown, selvedges 24 are substantially free of magnetically attractable material. In some other examples, the coating extends over the selvedges.

Figure 5:
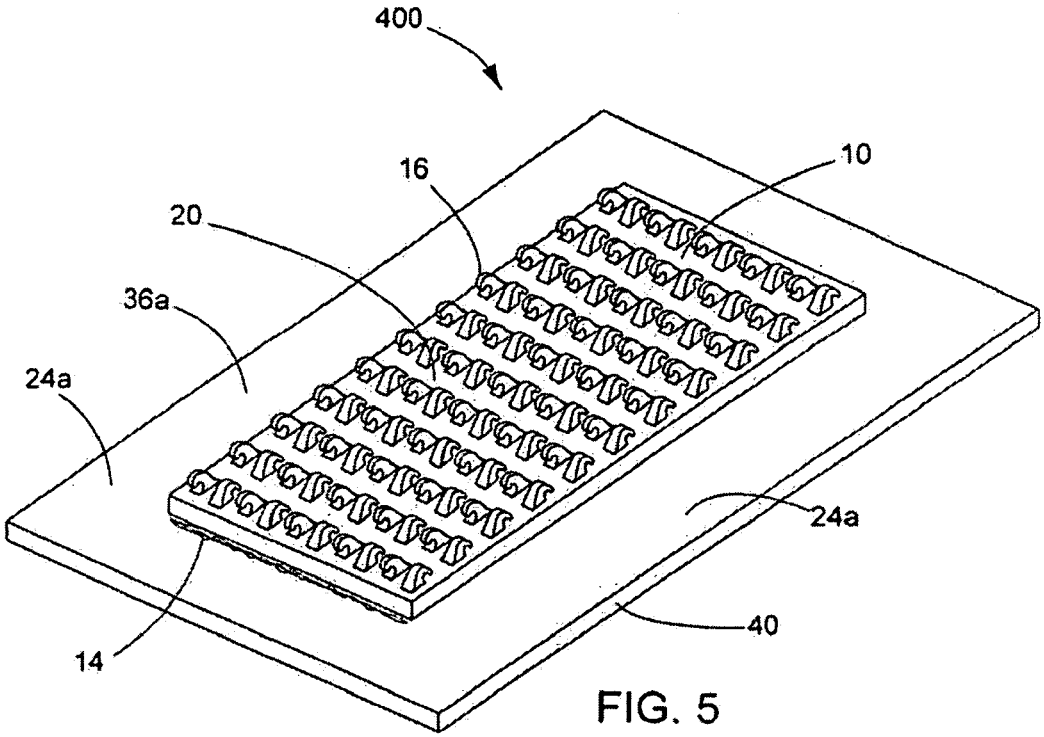
FIG. 5 is a perspective view of a touch fastener having selvedges of a film material.

Referring to FIG. 5, touch fastener 400 includes a base portion 10 having an upper face 12 and a lower face 14. Male fastener elements 16, such as hooks, extend from the lower face 14 of the base 10 in an array 20. A magnetically attractable wire 18 is secured to the upper face 12 of the base 10 with an adhesive 22*a*. A film 40 is adhered to the upper face 12 of the base 10 by adhesive 22*a* and extends laterally beyond the base 10 to form selvedges 24*a*. The selvedges 24*a* have a stiffness that readily allows for flexure out of the plane of touch fastener 400, for example, under force of magnetic attraction. As shown in FIG. 5 the film extends longitudinally beyond the sheet form base, forming flat portions 36*a* that can engage a mold surface in face-to-face contact.

The base 10 has a length of about 200 mm and a width of about 4 mm. The sheet form base is constructed from a resin, such as polyester, polypropylene, or nylon, and has a nominal thickness of about 0.010 inch. The array of fastener elements 20 extends over substantially the entire lower face 14 of the base 10. The film extends about 4 mm laterally beyond the base 10 and about 4 mm longitudinally beyond the base 10. The film is a polyamide film and has a nominal thickness of 0.005 inch. The fastener elements 16 are hooks positioned in alternating rows of hooks facing in opposing directions. Although a polyamide film is described in the present embodiment, other films could also be used, including polyurethane or other adhesive films.

Figure 6:
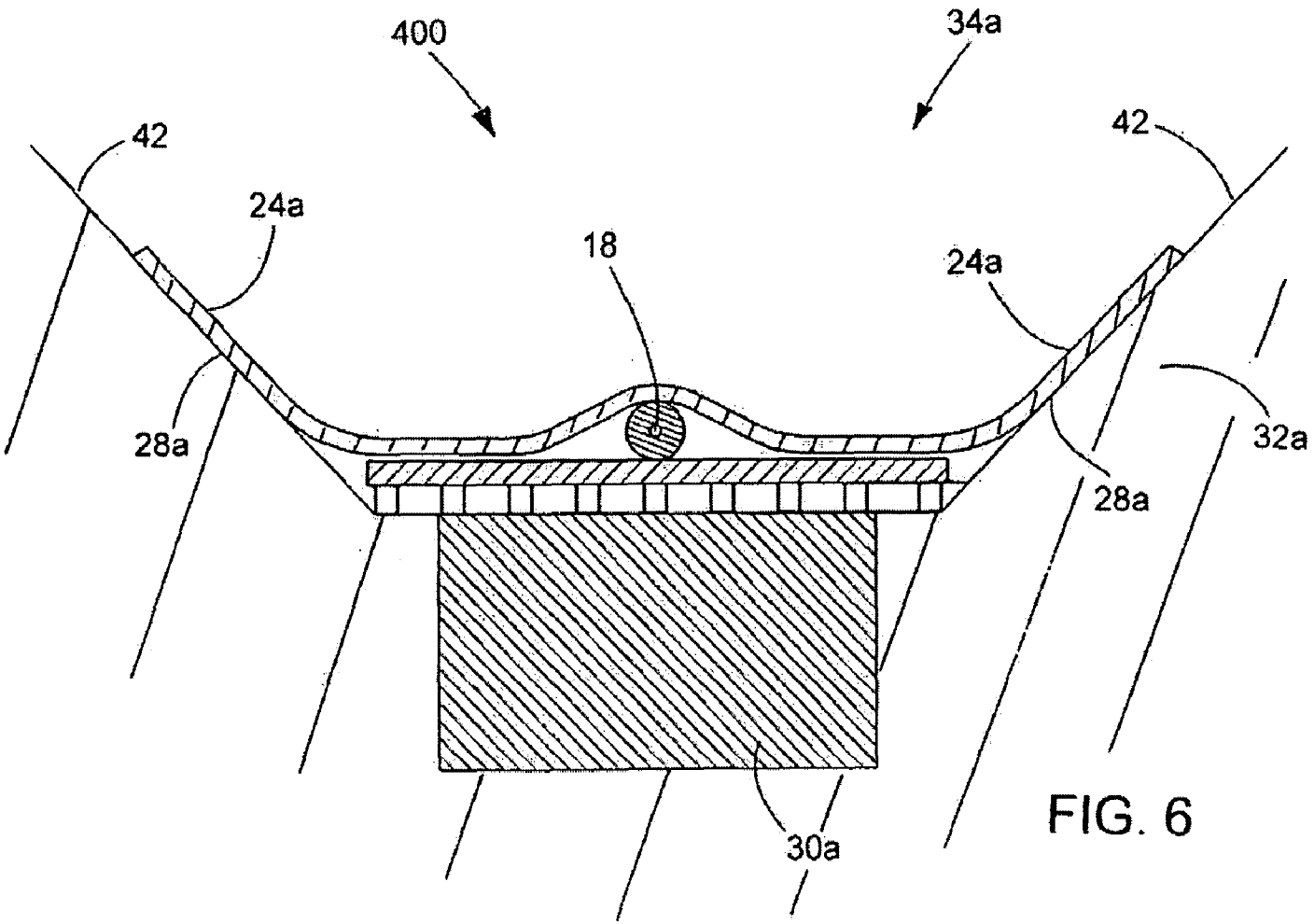
FIG. 6 is a cross-sectional view of the touch fastener of FIG. 5 positioned in a trench of a mold cavity.

FIG. 6 depicts a cross-sectional view of touch fastener 400 positioned in a mold 32*a*. A magnet 30*a* is positioned below a trench 34*a* portion of the mold, where the trench 34*a* has angled side portions 42. The force of magnetic attraction between magnet 30*a* and metal wire 18 holds touch fastener 400 in position against the surface of the mold trench 34*a* during foaming. During the molding process, selvedges 24*a* engage mold surface 28*a* in face-to-face contact to prevent fouling of fastener elements 16. Contact pressure between the selvedges and the mold wall is a function of the magnetic force applied to the wire 18, and the bending stiffness of the film 40.

Figure 6A:
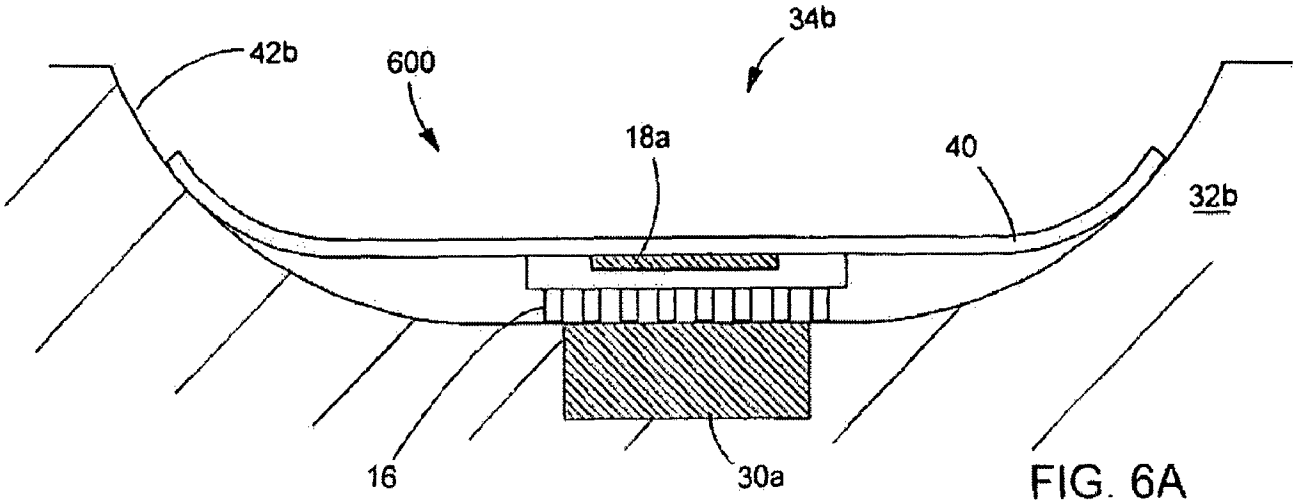
FIG. 6A is a cross-sectional view of another trench fastener positioned in a tapered trench.

FIG. 6A shows another example of a tapered trench, this one having arcuate side walls that extend upward from the bottom of the trench. The film 40 is of such a width that lateral edges of the film are deflected upward as the central portion of the fastener is drawn against the bottom of the trench. The illustrated fastener 600 includes a thin strip of magnetically attractable metal 18*a*, instead of a wire, disposed within the central portion of the strip-form product. Metal 18*a* may be in the form of a shim, for example, and may be perforated, and expanded to form holes through its thickness for improved resin adhesion. Strip 18*a* may be bonded to resin of base 10*a* as the base is formed, or adhered thereto by adhesive, such as adhesive binding film 40 to base 10*a*.

Figure 7:
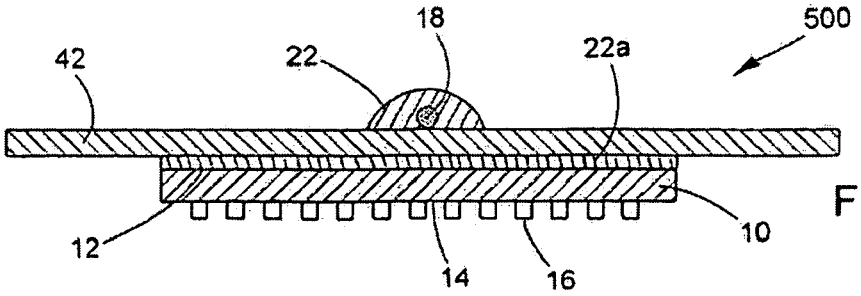

The touch fastener 500 of FIG. 7 is identical in structure to the one shown in FIG. 5, except that wire 18 is disposed on an opposite side of film 40, and held in place by a discrete bead of hot melt polyamide 22. Film 40 may be bonded to base 10 with adhesive 22*a* as shown, or directly laminated to the resin of the hook base.

Figure 8:
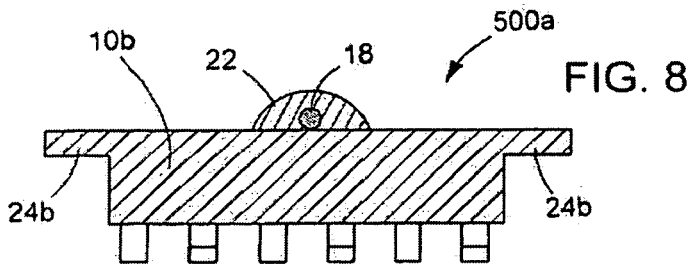
FIGS. 7 and 8 are cross-sectional views of alternate touch fastener constructions.

The touch fastener of 500*a* of FIG. 8 is similar iii structure to the touch fasteners of FIGS. 5 and 7, except that touch fastener 500*a* is a single, unitary structure constructed of a resin material. The base portion 10*b* is integrally molded with selvedges 24*b* such that the nominal thickness of the base portion is greater than the nominal thickness of the selvedges. Like touch fastener 500, the wire 18 is adhered to the upper face of base 10*b* with adhesive 22.

Figure 10:
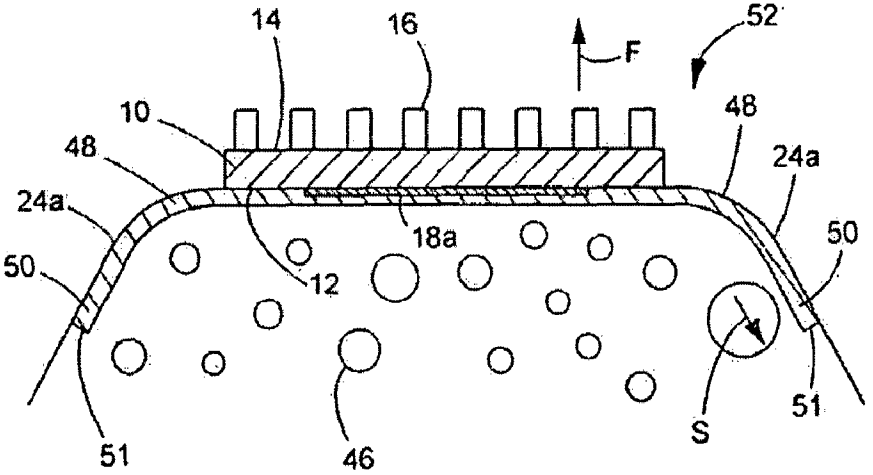
FIG. 10 is an enlarged view of area 10 of FIG. 9.
Figure 9:
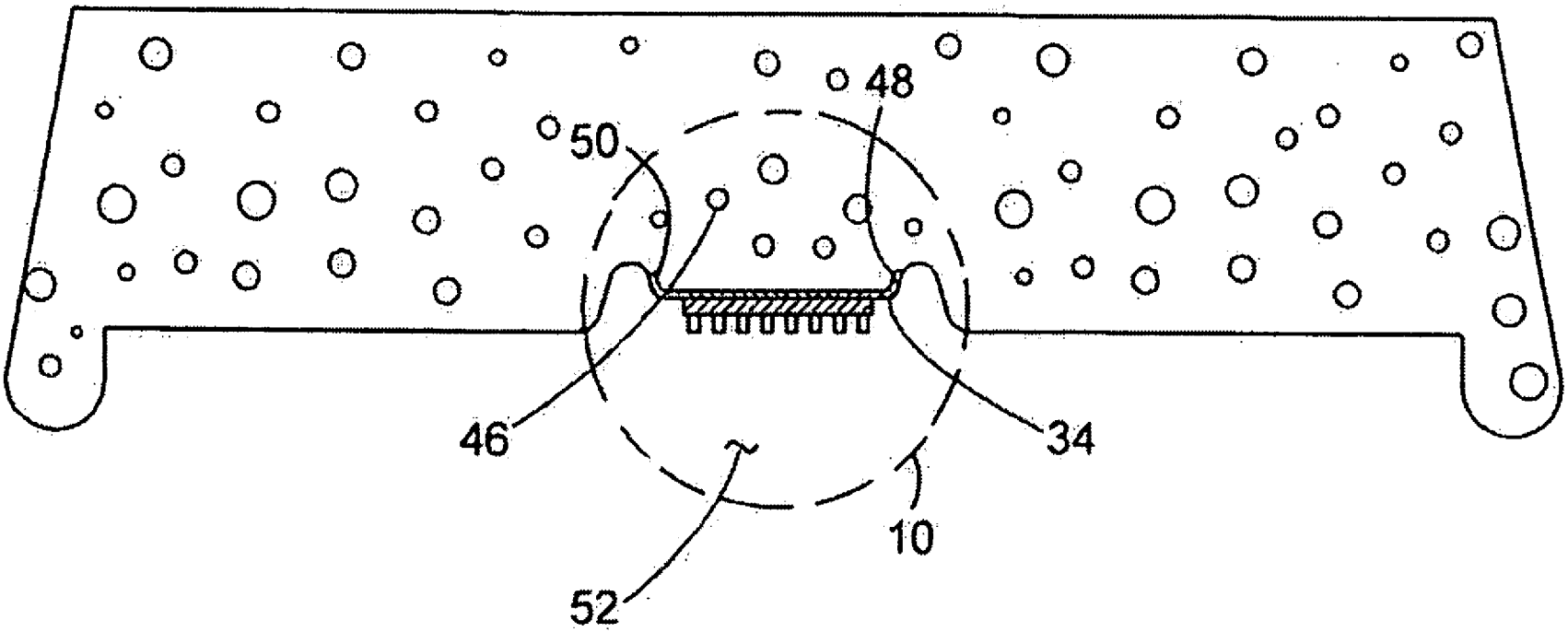
FIG. 9 is a cross-sectional view of a seat foam bun.

In some instances, the touch fasteners are molded into a seat foam bun, for example as depicted in FIGS. 9 and 10. Molded seat foam bun 700, depicted in FIG. 9, includes a trench portion 44, which includes a plateau 46 having lateral edges 48 and angled side walls 50. A touch fastener 52 is molded into plateau 46 and extends across lateral edges 48 and along a portion of angled sides 50, such that the distal edges 51 of the fastener are disposed out of the plane of the fastener element array, and directed town into the bun. Touch fastener 52 includes a base 10 portion having an upper face 12 and a lower face 14. Extending from the lower face 14 are male fastener elements 16 having stems integrally molded thereto. A magnetically attractable strip 18*a* is adhered to the upper face 12 of the base 10 and a film 40 covers magnetically attractable strip 18*a* and expands beyond the lateral edges of the base 10 to form selvedges 24*a*. The selvedges 24*a* are molded into the seat foam bun 700, creating a smooth surface on the lateral edges 48 and angled side 50 walls of the plateau 46.

In general, the extension of selvedges 24*a* down side walls 50 can provide strong adherence between touch fastener 52 and seat foam bun 700 and improved resistance to delamination. For example, when upward force "F" is applied to touch fastener 52, at least a portion of that upward force is resisted by a shear force "S" between angled selvedges 24*a* underlying foam and helping to prevent cracks from forming between touch fastener 52 and seat foam bun 700, which can lead to dislocation of touch fastener 700.

For use in a tapered trench as shown in FIGS. 6 or 6A, the selvedges 24*a* of the fastener product preferably are of a bending stiffness or flexural rigidity sufficiently low to enable the selvedges to be deflected into face-to-face contact with the side walls of the trench, and to allow the attractable magnetic forces to pull the central portion of the fastener product into planar contact with the bottom of the trench across the entire hook array. However, the selvedge bending stiffness should also be high enough to maintain a contact pressure between the selvedges and mold surface, preferably even along the lateral edges of the selvedges during the foaming process. For many applications employing typical mold magnets and reasonable trench widths, a selvedge material having a flexural rigidity of between about 1000 and 3000 gm-cm, as measured in accordance with the Cantilever Test option of ASTM D1388, should be suitable. However, different applications may require varying the selvedge stiffness to optimize results. For example, while film has been described as suitable selvedge material, other materials can also be used to form selvedges, including paper or other fibrous material, rubber, cotton, or horse hair.

Figure 11:
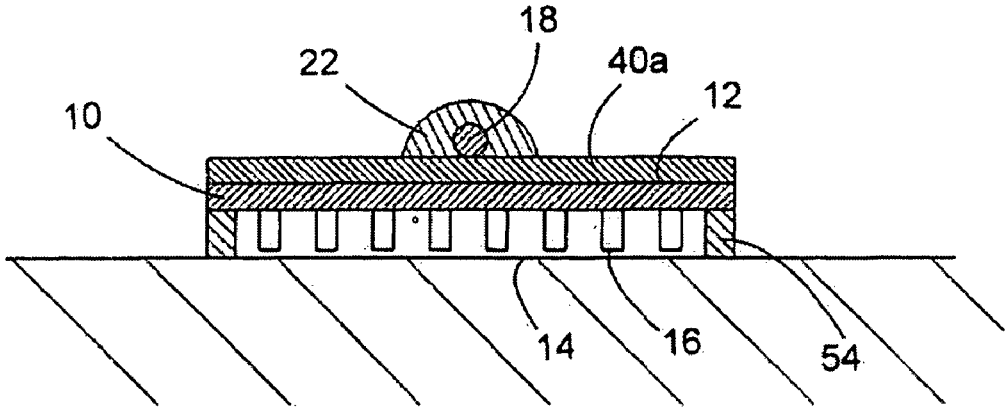
FIG. 11 is a cross-sectional view of a touch fastener having a film adhered to the upper face of the sheet-form base.

As depicted in FIG. 11, touch fastener 800 includes a sheet-form base 10 with an upper face 12 and a lower face 14. Fastener elements 16 extend in an array 20 from lower face 14 of sheet-form base 10. A film 40*a* is secured to upper face 12 of sheet-form base 10. A metal wire 18 is secured with an adhesive 22 to film 40*a*.

Touch fastener 800 is particularly useful as a mold insert for the forming of a seat form bun. In particular, film 40*a* has a softening point low enough that the heat produced by the exothermic foaming reaction of bun molding at least partially activates the exposed surface of the film; physically adhering the fastener to the foaming resin. Adherence may be due to the softened film becoming activated to provide an improved adhesion of the foam to the film, or may be by chemical bonding of the film and foam.

FIG. 11 also illustrates a gasket material 54 positioned around the array of fastener elements 16, such that when touch fastener 800 is positioned against a flat mold surface 55, material 54 forms a seal against the mold surface during the foaming process, acting as a barrier to protect fastener elements 16 from foam intrusion. The sealing of the gasket formed between material 54 and the mold surface is aided by a magnetically attractable force between metal wire 18 and a magnet (not shown) positioned below the mold surface.

Figure 12:
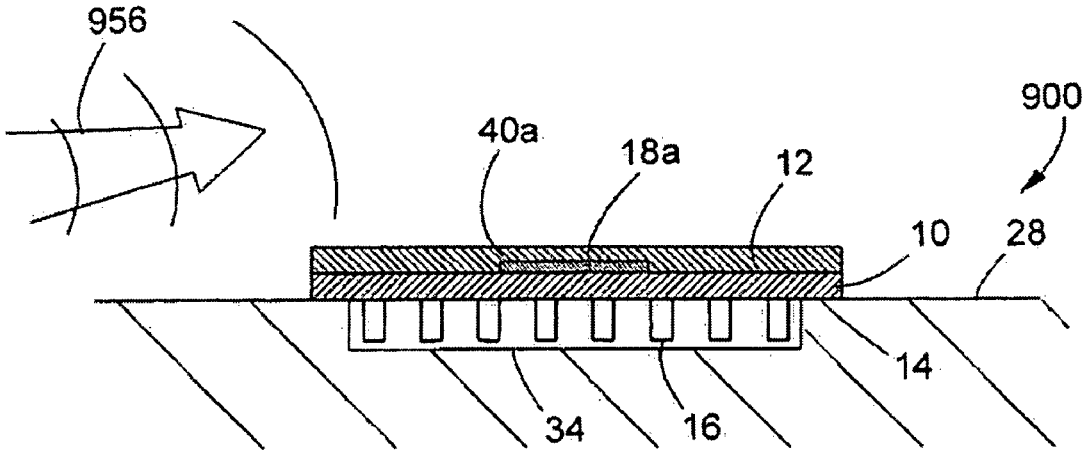
FIG. 12 is a cross-sectional view of a touch fastener positioned in a mold trench during a foaming process.
Figure 13:
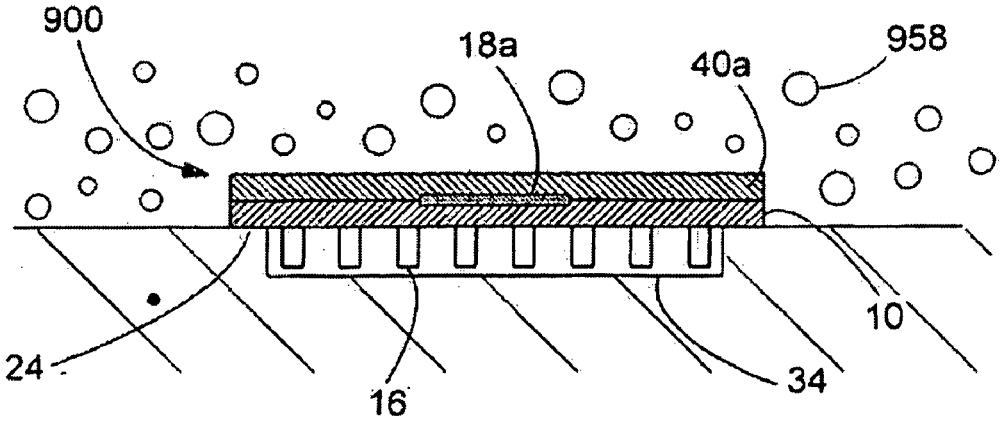
FIG. 13 shows the touch fastener and trench of FIG. 12 upon completion of the foaming process.

FIGS. 12 and 13 depict touch fastener 900 positioned over a trench 34 of a mold 32 during a foaming process. Touch fastener 900 includes a sheet-form base 10 having an upper face 12 and a lower face 14. Lower face 14 includes male fastener elements 16 with stems integrally molded thereto. Upper face 12 includes a magnetically attractable strip of material 18*a* positioned above the male fastener elements 16. Film 40*a* is positioned over magnetically attractable strip of material 18*a* and adhered to the upper face 12 of the sheet-form base 10. The sheet-form base 10 extends laterally beyond the male fastener elements 16 and engages a smooth mold surface 28*a* in face-to-face contact, providing a barrier that prevents the foamable resin 958 from fouling fastener elements 16.

During the bun molding process, foamable resin 56 is added the mold 32. The foamable resin 56 reacts in an exothermic manner, producing heat as it forms into a solid seat foam bun. The foaming reaction may advance across the touch fastener 900, first encountering only the edge of the selvedge, which is thin enough to not impede expansion of the foam across the mold surface. Moreover, the smooth surface also aids the expansion of the foam across the surface. As the foaming reaction proceeds across the exposed film, the temperature of the film surface nears its softening point and becomes physically adhered to the foam 58, either by mechanical or chemical bonding enhanced by the thermal attraction of the film. Although described as a film, thermally-activatable resin may be provided as an exposed surface of fastener 900, as a coating, as discrete beads or ribs, or other form.

Any of the fastener products discussed above may also be provided with protrusions or other fasteners on its back surface, which are shaped to become embedded in the foam of the seat bun to mechanically lock the fastener into the bun.

Examples of suitable thermally activatable resins that can be provided as films or in other forms include polyamides, polyurethanes, and other hot melt adhesives.

A number of embodiments of the invention have been described. Nevertheless, it will be understood that various modifications may be made without departing from the spirit and scope of the invention.

Accordingly, other embodiments are within the scope of the following claims.

What is claimed is:

1. A method of forming a molded foam article comprising:

providing a mold cavity having a shape corresponding to the shape of the article to be molded, wherein the mold cavity comprises a tapered trench;

providing a touch fastener comprising a base, a plurality of fastener elements extending from a lower face of a central portion of the base in an array disposed between lateral selvedges of the base;

positioning the touch fastener along the trench with the selvedges deflected from their unloaded position to extend in face-to-face contact with side walls of the tapered trench; and delivering a foamable resin into the mold cavity to form the molded article, the deflected selvedges resisting intrusion of foamable resin into the array of fastener elements.

2. The method of claim 1 wherein a lower face of the selvedges has a substantially flat surface in the unloaded position.

3. The method of claim 1 wherein the selvedges are of a significantly lesser stiffness than a stiffness of the central portion of the base.

4. The method of claim 1 wherein the trench has flat side walls extending at acute angles from a bottom surface of the trench.

5. The method of claim 1 wherein the trench includes curved side walls, the selvedges conforming to arcuate surfaces of the trench side walls.

6. The method of claim 1 wherein in an unloaded condition, the selvedges and central portion of the base lie in a common plane, the distal edges of the selvedges being deflected out of the common plane with the fastener positioned along the trench.

7. The method of claim 6 wherein the distal edges of the selvedges contacting the trench side walls with the fastener positioned along the trench.

8. The method of claim 1 wherein the selvedges are disposed around all sides of the central portion of the base.

9. The method of claim 1 wherein the selvedges comprise a film.

10. The method of claim 9 wherein the film comprises a polyamide.

11. The method of claim 9 wherein the film is adhered to the base.

12. The method of claim 11 wherein the film is adhered to the base with a polyamide hot melt resin.

13. The method of claim 9 wherein the film has a softening point between 120 and 220 degrees Fahrenheit.

14. The method of claim 1 wherein the central portion of the base has a nominal thickness of between about 0.002 and 0.012 inch.

15. The method of claim 1 wherein the central portion of the base is thicker than the selvedges.

16. The method of claim 1 wherein the touch fastener includes a magnetically attractable material.

17. The method of claim 16 wherein the magnetically attractable material is disposed on the upper face of the central portion of the base.

18. The method of claim 16 wherein the selvedges are substantially free of magnetically attractable material.

19. The method of claim 16 wherein the trench overlays a magnet.

20. The method of claim 1 wherein the trench is elongated, and the fastener product is in strip form.

21. The method of claim 1 wherein the fastener elements are male fastener elements having stems integrally molded with a surface of the central portion of the base.

22. The method of claim 1 wherein the foamable resin comprises a polyurethane resin.

23. A method of forming a molded foam article, the method comprising:

providing a mold cavity having a shape corresponding to a desired shape of the article to be molded, the mold cavity including a tapered trench;

positioning a touch fastener in the mold cavity, the touch fastener comprising a sheet-form base comprising an upper face and a lower face, a plurality of fastener elements disposed on the lower face of the sheet-form base, and a thermally-activatable resin exposed on the upper face of the sheet-form base, such that selvedges of the touch fastener are deflected from an unloaded position to extend in face-to-face contact with side walls of the tapered trench; and delivering a foamable resin into the mold cavity causing the resin to foam in an exothermic reaction, wherein the reaction generates sufficient heat to activate at least an outer surface of the activatable resin to adhere the touch fastener to the foam.

24. The method of claim 23 wherein the foamable resin comprises a polyurethane.

25. The method of claim 23 wherein the activatable resin is activated at a temperature between about 120 and 220 degrees Fahrenheit.

26. The method of claim 23 wherein the activatable resin comprises a film.

27. The method of claim 26 wherein the film comprises a polyamide film.

28. The method of claim 23 wherein the resin is disposed over substantially the entire upper face of the base.

29. The method of claim 23 wherein the touch fastener comprises a magnetically attractable material disposed on the upper face of the base.

30. The method of claim 29 wherein the magnetically attractable material is a metal wire laterally centered over the fastener elements.

31. The method of claim 23 wherein the touch fastener comprises a material disposed on the lower face of the base, the material surrounding the plurality of fastener elements and forming a gasket between the base and a surface of the mold cavity.

32. The method of claim 23 wherein the touch fastener comprises selvedges extending laterally beyond the plurality of fastener elements.

33. The method of claim 32 wherein the selvedges extend longitudinally beyond the plurality of fastener elements.

34. The method of claim 32 wherein the selvedges are integrally molded with the base.

35. The method of claim 32 wherein the selvedges comprise a film disposed on the upper surface of the base.

36. The method of claim 32 wherein the selvedges comprise a smooth surface that engages a mold surface in face-to-face contact.

* * * * *